US005652951A

United States Patent [19]

Thayer et al.

[11] Patent Number: 5,652,951

[45] Date of Patent: Jul. 29, 1997

[54] DETONING CYCLE TO INCREASE BRUSH LIFE AND REDUCE EMISSIONS BY REMOVING ACCUMULATED TONER

[75] Inventors: Bruce E. Thayer; Dennis G. Gerbasi, both of Webster; Ronald E. Auty, Rochester; Nero R. Lindblad; Clark V. Lange, both of Ontario; Karen H. Kuntz, Webster, all of N.Y.

[73] Assignee: Xerox Corporation, Stamford, Conn.

[21] Appl. No.: 573,988

[22] Filed: Dec. 18, 1995

[51] Int. Cl.[6] ..... G03G 21/00

[52] U.S. Cl. ..... 399/71; 399/354

[58] Field of Search ..... 355/296, 297, 355/301, 302, 203, 208; 399/71, 353, 354

[56] References Cited

U.S. PATENT DOCUMENTS

| | | | |
|---|---|---|---|
| 4,811,046 | 3/1989 | May | 355/4 |
| 5,177,553 | 1/1993 | Ohike et al. | 355/301 |
| 5,229,817 | 7/1993 | Lange et al. | 355/296 |
| 5,237,377 | 8/1993 | Harada et al. | 355/301 |
| 5,291,259 | 3/1994 | Weitzel | 355/306 |

FOREIGN PATENT DOCUMENTS

| | | | |
|---|---|---|---|
| 62-242984 | 10/1987 | Japan | 355/301 |
| 1-25182 | 1/1989 | Japan | 355/302 |
| 6-167912 | 6/1994 | Japan | 355/302 |

*Primary Examiner*—Joan H. Pendegrass
*Attorney, Agent, or Firm*—T. L. Fair

[57] ABSTRACT

An apparatus and method is disclosed for increasing brush life and reducing emissions by removing accumulated toner using detoning cycles. A further embodiment of the disclosure is a method for periodic brush-reversing detoning cycle occurring during a standby condition.

20 Claims, 4 Drawing Sheets

DETONING CYCLE TO INCREASE BRUSH LIFE AND REDUCE EMISSIONS BY REMOVING ACCUMULATED TONER

BACKGROUND OF THE INVENTION

This invention relates generally to an electrostatographic printer or copier, and more particularly concerns a detoning cycle.

Current electrostatic brush detoning roll cleaners encounter the problem of having too much toner in the brush after prolonged use. A gradual accumulation of toner occurs due to incomplete detoning of the brush by the detoning roll. The brush then has to be vacuumed or replaced.

If detoning the brush is not 100% effective, the toner will gradually accumulate in the brush. When enough toner has accumulated, problems occur including the toner being emitted from the brush, the fiber tips no longer clean upon entering the cleaning nip, and the fibers are held in a bent position reducing contact with the photoreceptor. When these problems occur, the cleaning brushes require vacuuming to remove toner or brush replacement to restore acceptable performance. For example, in the Xerox 5100 machine, the cleaner brushes are vacuumed every 300K to remove toner from the brush that the detoning roll did not remove. When the Xerox 5100 machine brush has more than 30 grams of toner in the brush, toner clouding from the brush contaminates the machine.

Another problem that occurs is with small diameter (e.g. D=25 mm) brushes. The areas of the brush with large toner accumulation have more of a radial set than portions of the brush with lower toner accumulation. When a large accumulation of toner is present in the brush, the toner holds the brush down in the set condition (i.e. the toner forms a "mat" which holds the fibers down). This increased set reduces the cleaning efficiency of the brush. When the toner is removed from the brush, the fibers recover from this increased set. Problems caused by toner accumulation in the brush occur even with excellent detoning efficiencies, i.e. greater than 99.5%, due to gradual accumulation. Hence, better detoning efficiency delays the need for brush service rather than resolving the problem that leads to servicing the brush.

The following disclosures may be relevant to various aspects of the present invention and may be briefly summarized as follows:

U.S. Pat. No. 5,291,259 to Weitzel et al discloses an image forming apparatus which includes a toner cleaning device for cleaning toner off an image surface. The cleaning device includes a cleaning applicator for moving magnetic particulate cleaning material past the surface to be cleaned. Particulate material is moved from a sump to the cleaning applicator by a transport positioned between them. A detoning roller is positioned to attract toner from particulate material associated with the transport. When the cleaning device is not cleaning, it has a mode of operation in which the transport and the detoning roller continue to operate to continue to detone particulate material which moves from the sump around the transport and back to the sump.

U.S. Pat. No. 4,811,046 to May discloses undesirable transient development conditions that occur during start-up and shut-down in a tri-level xerographic system when the developer biases are either actuated or de-actuated are obviated by the provision of developer apparatuses having rolls which are adapted to be rotated in a predetermined direction for preventing developer contact with the imaging surface during periods of start-up and shut-down. The developer rolls of a selected developer housing or housings can be rotated in the contact preventing direction to permit use of the tri-level system to be utilized as a single color system or for the purpose of agitating developer in only one of the housings at time to insure internal triboelectric equilibrium of the developer in that housing.

SUMMARY OF INVENTION

Briefly stated, and in accordance with one aspect of the present invention, there is provided an apparatus for cleaning particles from a surface in a printing machine, the printing machine having an operational mode and a non-operational mode, comprising: means for cleaning particles from the surface, the cleaning means having movement in the non-operational mode; means for detoning particles from the cleaning means, the detoning means having movement in the non-operational mode; and a detoning cycle for removing particles from the cleaning means at periodic intervals to prevent excess build up of the particles in the cleaning means.

Pursuant to another aspect of the present invention, there is provided a method for removing particles from a surface, with a detoning member, in an electrostatographic machine in contact with a cleaning member, comprising: stopping operation of the electrostatographic machine; and moving the detoning member and the cleaning member, relative to one another to enable removal of the particles from the cleaning member.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

For a general understanding of a color electrostatographic printing or copying machine in which the present invention may be incorporated, reference is made to U.S. Pat. Nos. 4,599,285 and 4,679,929, whose contents are herein incorporated by reference, which describe the image on image process having multi-pass development with single pass transfer. Although the cleaning method and apparatus of the present invention is particularly well adapted for use in a color electrostatographic printing or copying machine, it should become evident from the following discussion, that it is equally well suited for use in a wide variety of devices and is not necessarily limited to the particular embodiments shown herein.

Figure 4:
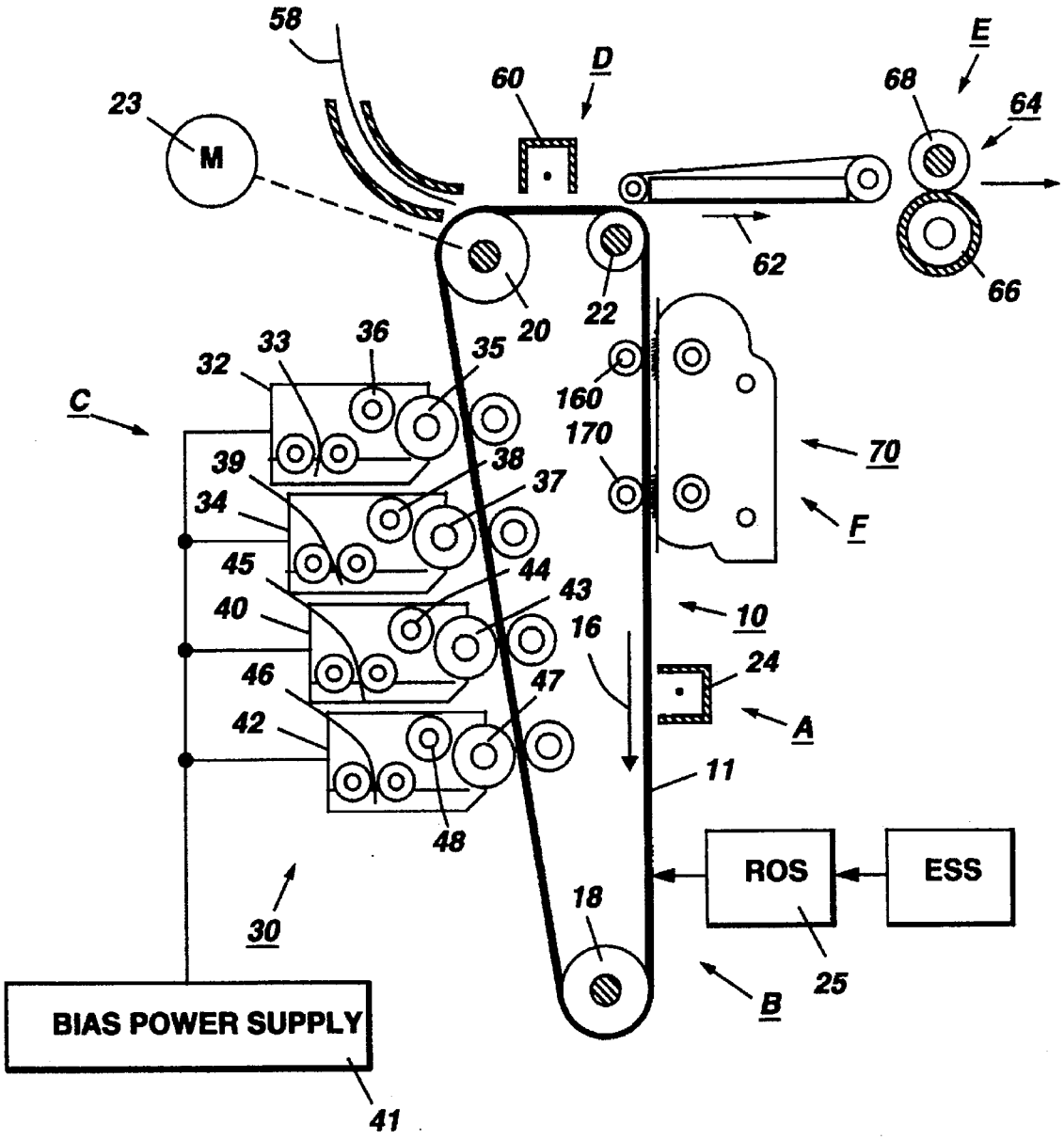
FIG. 4 is a schematic illustration of a printing apparatus incorporating the inventive features of the present invention.

Referring now to the drawings, where the showings are for the purpose of describing a preferred embodiment of the invention and not for limiting same, the various processing stations employed in the reproduction machine illustrated in FIG. 4 will be briefly described.

A reproduction machine, from which the present invention finds advantageous use, utilizes a charge retentive member in the form of the photoconductive belt 10 consisting of a photoconductive surface and an electrically conductive, light transmissive substrate mounted for movement pass charging station A, and exposure station B, developer stations C, transfer station D, fusing station E and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used to provide suitable tensioning of the photoreceptor belt 10. Motor 23 rotates roller 20 to advance belt 10 in the direction of arrow 16. Roller 20 is coupled to motor 23 by suitable means such as a belt drive.

As can be seen by further reference to FIG. 4, initially successive portions of belt 10 pass through charging station A. At charging station A, a corona device such as a scorotron, corotron or dicorotron indicated generally by the reference numeral 24, charges the belt 10 to a selectively high uniform positive or negative potential. Any suitable control, well known in the art, may be employed for controlling the corona device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device (for example, a two level Raster Output Scanner (ROS)).

The photoreceptor, which is initially charged to a voltage, undergoes dark decay to a voltage level. When exposed at the exposure station B it is discharged to near zero or ground potential for the image area in all colors.

At development station C, a development system, indicated generally by the reference numeral 30, advances development materials into contact with the electrostatic latent images. The development system 30 comprises first 42, second 40, third 34 and fourth 32 developer apparatuses. (However, this number may increase depending upon the number of colors, i.e. here four colors are referred to, thus, there are four developer housings.)

The first developer apparatus 42 comprises a housing containing a donor roll 47, a magnetic roller 48, and developer material 46. The second developer apparatus 40 comprises a housing containing a donor roll 43, a magnetic roller 44, and developer material 45. The third developer apparatus 34 comprises a housing containing a donor roll 37, a magnetic roller 38, and developer material 39. The fourth developer apparatus 32 comprises a housing containing a donor roll 35, a magnetic roller 36, and developer material 33. The magnetic rollers 36, 38, 44, and 48 develop toner onto donor rolls 35, 37, 43 and 47, respectively. The donor rolls 35, 37, 43, and 47 then develop the toner onto the imaging surface 11. It is noted that development housings 32, 34, 40, 42, and any subsequent development housings must be scavengeless so as not to disturb the image formed by the previous development apparatus. All four housings contain developer material 33, 39, 45, 46 of selected colors. Electrical biasing is accomplished via power supply 41, electrically connected to developer apparatuses 32, 34, 40 and 42.

Sheets of substrate or support material 58 are advanced to transfer D from a supply tray, not shown. Sheets are fed from the tray by a sheet feeder, also not shown, and advanced to transfer D through a corona charging device 60. After transfer, the sheet continues to move in the direction of arrow 62, to fusing station E.

Fusing station E includes a fuser assembly, indicated generally by the reference numeral 64, which permanently affixes the transferred toner powder images to the sheets. Preferably, fuser assembly 64 includes a heated fuser roller 66 adapted to be pressure engaged with a back-up roller 68 with the toner powder images contacting fuser roller 66. In this manner, the toner powder image is permanently affixed to the sheet.

After fusing, copy sheets are directed to a catch tray, not shown, or a finishing station for binding, stapling, collating, etc., and removal from the machine by the operator. Alternatively, the sheet may be advanced to a duplex tray (not shown) from which it will be returned to the processor for receiving a second side copy. A lead edge to trail edge reversal and an odd number of sheet inversions is generally required for presentation of the second side for copying. However, if overlay information in the form of additional or second color information is desirable on the first side of the sheet, no lead edge to trail edge reversal is required. Of course, the return of the sheets for duplex or overlay copying may also be accomplished manually. Residual toner and debris remaining on photoreceptor belt 10 after each copy is made, may be removed at cleaning station F with a brush or other type of cleaning system 70. The cleaning system is supported under the photoreceptive belt by two backers 160 and 170.

Figure 1:
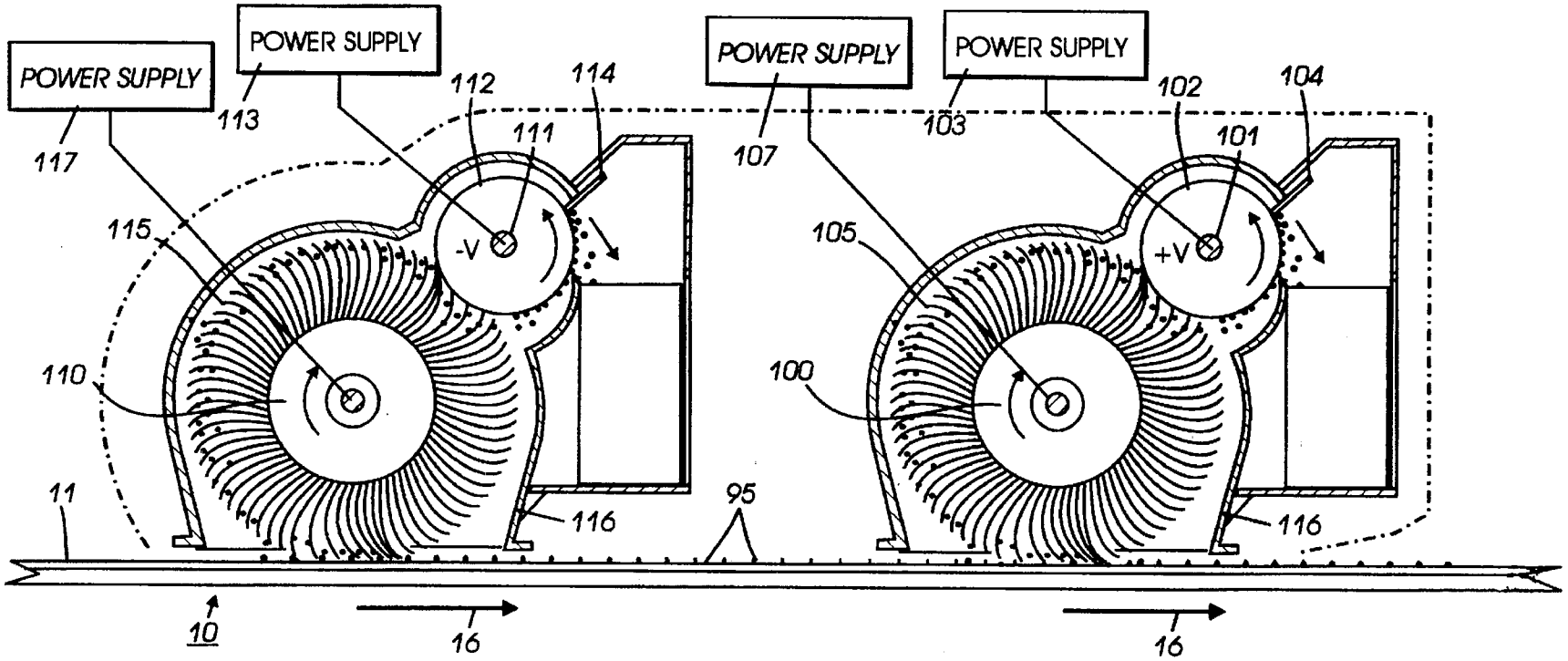
FIG. 1 is a schematic of dual electrostatic brush cleaner with detoning rolls.

Reference is now made to FIG. 1, which shows dual electrostatic brush cleaners with detoning rolls. Electrostatic brushes 100, 110 with detoning rolls 102, 112 operate by removing toner 95 from the photoreceptor 10 with both mechanical and electrostatic forces. The fibers 105, 115 on the brush 100, 110 mechanically dislodge residual toner particles 95 from the photoreceptor 10 and electrostatically hold the toner particles 95 onto the fibers 105, 115. The toner 95 is then transported by the brush 100, 110 to the detoning roll 102, 112 where the toner particles 95 are stripped from the brush fibers 105, 115 by electrostatic forces. The electrostatic fields for cleaning and detoning are created by connecting the conductive brush 100, 110 to the appropriate power supply voltages 107, 117 and the core 101, 111 of the detoning roll 102, 112 to appropriate power supply voltages 103, 113.

Current electrostatic brush detoning roll cleaners encounter the problem of having too much toner in the brush after prolonged use. A gradual accumulation of toner occurs due to incomplete detoning of the brush by the detoning roll. The brush then has to be vacuumed or replaced. This invention proposes using a detoning cycle during certain standby intervals to remove toner that has accumulated in the brush. This enables better cleaning by the brush, less fiber set from accumulated toner and lower toner emissions which results in longer brush life and lower service cost.

In the present invention a detoning cycle is utilized to remove toner 95 from the brush 100, 110 and increase the life of the brush 100, 110. A detoning cycle is an operation used for removing toner 95 from the brush 100, 110 before it can build to a level that would cause unacceptable emissions and cleaning failures, resulting in requiring servicing of the cleaner brushes 100, 110 by a technical representative or even the customer. (Note: A sensing mechanism can be used to determine when an unacceptable emission level occurs.) A detoning cycle is used when cleaning of the photoreceptor is not required.

Figure 2:
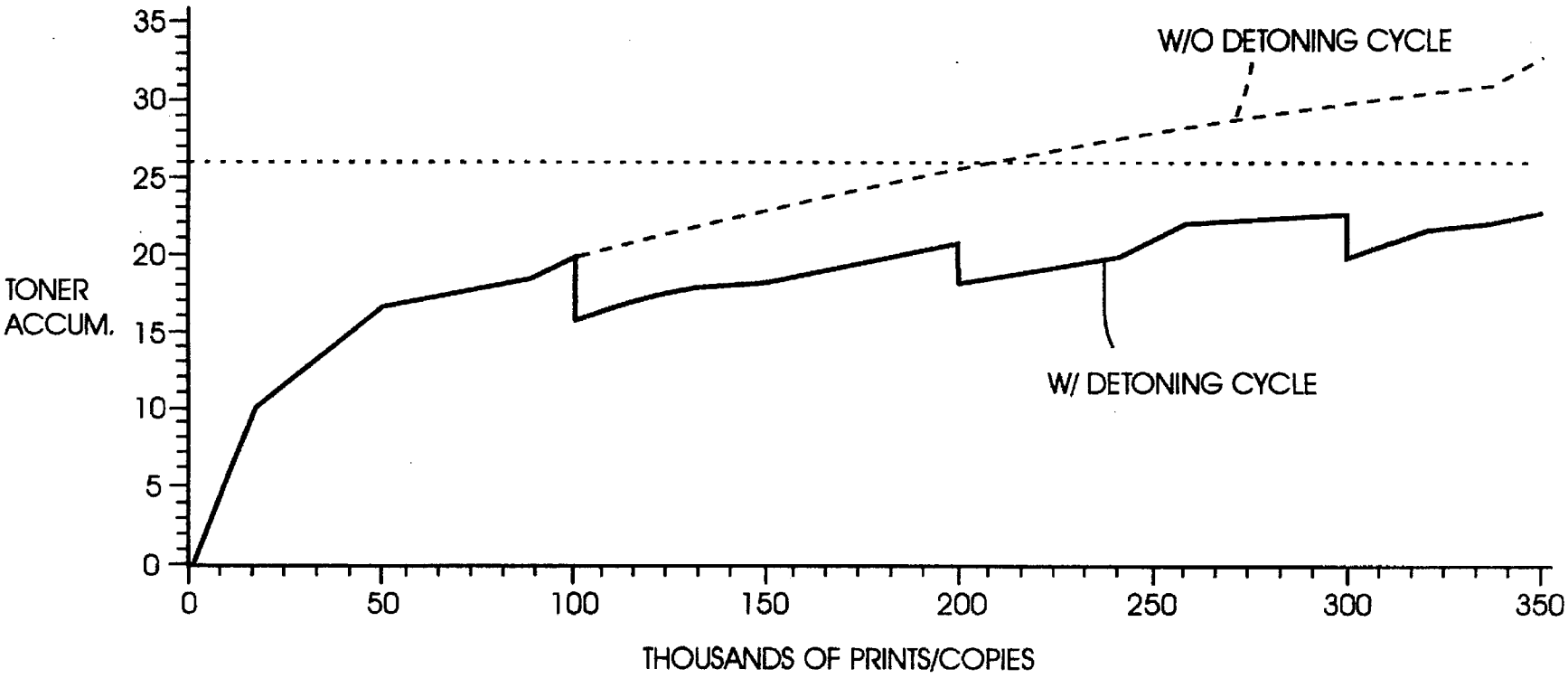
FIG. 2 is a graphical illustration of the detoning cycle of the present invention.

Reference is now made to FIG. 2, which shows a graphical illustration of the detoning cycle of the present invention. The detoning cycle allows changes to critical parameters or detoning mechanisms that cannot be used during normal run conditions. When accumulations of toner reach a critical level of, for example, approximately 26 grams of toner (i.e. test data), unacceptable emissions result and the brush needs to be serviced. The dashed line of FIG. 2 represents toner accumulation in the brush without the use of a detoning cycle. As shown by the graph, without a detoning cycle, at approximately 200K prints the brush accumulates too much toner, thus requiring servicing to remove this excess toner before emission and other previously mentioned problems occur. The solid line of FIG. 2 represents toner accumulation in the brush when a detoning cycle is used. For the sample data shown in FIG. 2, the detoning cycle of the present invention, is repeated at 100K print intervals. At each detoning cycle, some of the accumulated toner in the brush is removed thus preventing the build up of excess toner. This process prolongs the life of the brush and minimizes toner emissions and brush service actions. In the example shown in FIG. 2, by performing a detoning cycle every 100K prints, the brush life is extended by nearly a factor of two (i.e. 200K prints brush life is achieved without the use of detoning cycles, as indicated by the dotted line. When the detoning cycle is employed at each 100K prints, as shown by the solid line in FIG. 2, the brush life is increased to greater than 350K prints.)

In order to implement a detoning cycle, a method of removing toner from the brush while it is not being used for cleaning is required. This non-operational mode can occur from about five seconds to a continuous time frame as occurs during standby. There are a variety of detoning methods that could be utilized during a detoning cycle. One such method is to change the brush direction to increase the detoning of the brush. Experimental testing of this method showed that reversing the brush direction when the cleaner is in a standby mode (i.e. the photoreceptor is not moving and cleaning of the photoreceptor is not needed) significantly removes the toner particles from the brush.

Figure 3:
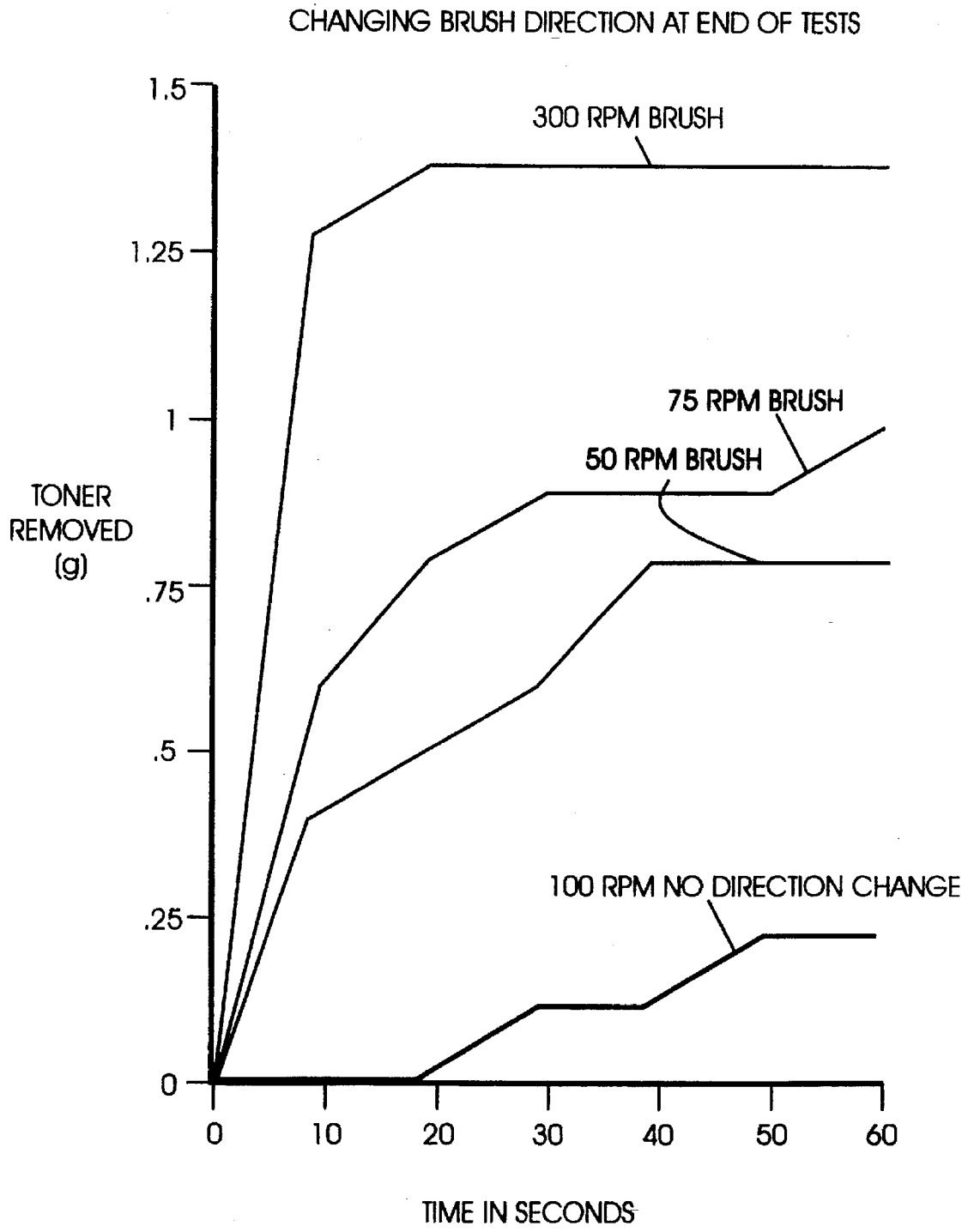
FIG. 3 is a graphical depiction of time vs. toner removed showing the changing brush direction.

Reference is now made to FIG. 3, which shows graphically time vs. toner removed from cleaning brush relative to changing the brush direction. (The rotational speed of the brush can range from about 5 rpm to about 2000 rpm.) FIG. 3 is the graphical results of a five minute experiment to "load" the brush with toner and then remove this toner from within the brush. The photoreceptor was removed to simulate a retracted cleaner. FIG. 3 shows detoning of the cleaner brush for 60 seconds at various speeds while being removed and weighed every 10 seconds. These various speeds (i.e. rpm) are indicated on the lines in the graph. As shown in the graph, a significant increase in detoning occurs when the brush direction is reversed (i.e. at 300 rpm, 75 rpm and 50 rpm) compared to detoning when the brush is in the normal cleaning direction (i.e. 100 rpm). At 50 rpm, the least amount of toner emissions occurred, but the least percentage of toner was removed from the brush. At 300 rpm, the greatest percentage of toner was removed, but high emissions occurred.

A follow up experiment was run to take advantage of both characteristics by running for a short time of 30 seconds at 50 rpm (i.e. this is the time interval at which most of the toner is removed from the brush at this speed), and then continuing immediately with a 300 rpm test for 20 seconds. At 50 seconds, most of the toner had been removed with the remaining toner deep in the core, which has no contact with the detoning roll. By starting slow and increasing the brush rotation, toner emissions can be minimized while still removing a great deal of toner. When the test was continued at 180 seconds, approximately 85% of the toner had been removed from the brush. To the naked eye, the brush appeared to be fully detoned, although the toner accumulation in the core was still apparent when spreading apart the bristles. By reversing the brush rotation the fibers are spread apart by driving them in the opposite direction of fiber set, thereby enabling the toner particles to escape the brush fibers for easier removal. Hence, the most substantial results for detoning were obtained within the first few seconds of testing.

The periodic brush-reversing detoning cycle of the present invention (for example, every 1K copies) occurs during a standby condition (e.g. a non-operational mode) with the cleaner retracted (or not retracted) from the photoreceptor. Reversing the direction of the cleaning brushes during a detoning cycle is applicable to a retractable miniaturized dual electrostatic brush cleaner as well where there is no concern about the effects of the spinning brushes on the photoreceptor. If toner emissions become problematic, a "door" may be incorporated to drop in between the cleaner and photoreceptor to ensure that any toner emissions remain inside the cleaner housing.

Changing the brush direction only slightly increases the UMC (i.e. unit manufacturing cost) of the cleaner. This increase in UMC can be as little as the cost to cover an extra idler gear incorporated into the design. The idler "kicks in" when the brush housing retracts from the photoreceptor, thus allowing rotation in the opposite direction from normal cleaning. This added cost of changing the direction of the brushes is substantially lower in comparison to vacuuming or replacing the brushes.

In recapitulation, the present invention discloses the use of detoning cycles to remove accumulated toner from the cleaner brushes. The detoning cycles increase brush life and reduce toner emissions. A further embodiment of the present invention is a periodic brush-reversing detoning cycle occurring during a standby condition (e.g. a non-operational mode) with the cleaner retracted from the photoreceptor.

It is, therefore, apparent that there has been provided in accordance with the present invention, a detoning cycle that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

It is claimed:

1. An apparatus for cleaning particles from a surface in a printing machine, the printing machine having an operational mode and a non-operational mode, comprising:

means for cleaning particles from the surface, said cleaning means having movement in the non-operational mode;

means for detoning particles from said cleaning means, said detoning means having movement in the non-operational mode;

a detoning cycle for removing particles from said cleaning means at periodic intervals to prevent excess build up of the particles in said cleaning means;

a sensing mechanism for activating the non-operational mode.

2. An apparatus as recited in claim 1, wherein said detoning cycle comprises removing the particles from said cleaning means prior to reaching a level of particles therein that provides unacceptable emissions levels and cleaning failures resulting in servicing of said cleaning means, the level of particles in said cleaning means activates said sensing mechanism prior to reaching unacceptable emissions levels.

3. An apparatus as recited in claim 2, wherein said cleaning means comprises a brush.

4. An apparatus as recited in claim 3, wherein said detoning means comprises a detoning roll.

5. An apparatus as recited in claim 4, wherein said brush being located between the surface and said detoning roll.

6. An apparatus as recited in claim 5, wherein said brush being rotatable in a first brush direction and a second brush direction, the first brush direction being opposite the second brush direction.

7. An apparatus as recited in claim 6, wherein the brush being rotatable changes from the first brush direction to the second brush direction during the non-operational mode.

8. An apparatus as recited in claim 7, wherein said brush, rotating in the second brush direction, contacts said detoning roll removing particles therefrom.

9. An apparatus as recited in claim 8, wherein the brush being rotatable changes from the second brush direction to the first brush direction during the operational mode.

10. An apparatus as recited in claim 9, wherein the brush being rotatable has a rotational speed ranging from about 5 rpm to about 2000 rpm.

11. An apparatus as recited in claim 10, wherein said non-operational mode of the printing machine comprises at least about a five second interval.

12. An apparatus as recited in claim 10, wherein said non-operational mode of the printing machine having a standby mode occurs continuously during the standby mode.

13. An apparatus as recited in claim 10, wherein said non-operational mode occurs in the printing machine after a predetermined number of copies are made.

14. An apparatus for cleaning particles from a surface in a printing machine, the printing machine having an operational mode and a non-operational mode, comprising:

a brush for cleaning particles from the surface, said brush having movement in the non-operational mode, said brush being rotatable in a first brush direction and a second brush direction, rotation in the first brush direction being opposite that of rotation in the second brush direction, said brush changes from the first brush direction to the second brush direction during the non-operational mode and said brush changes from the second brush direction to the first brush direction during the operational mode, said brush having a rotational speed ranging from about 5 rpm to about 2000 rpm;

a detoning roll for detoning particles from said brush, said detoning roll having movement in the non-operational mode, said brush being located between said detoning roll and the surface, said brush rotating in the second brush direction, contacts said detoning roll removing particles therefrom;

a detoning cycle for removing particles from said brush at periodic intervals to prevent excess build up of the particles in said brush, said detoning cycle comprises removing the particles from said brush prior to reaching a level of particles therein that provides unacceptable emissions levels and cleaning failures resulting in servicing of said brush; and a sensing mechanism for activating the non-operational mode.

15. An apparatus as recited in claim 14, wherein the level of particles in said brush activates said sensing mechanism prior to reaching unacceptable emissions levels.

16. A method for removing particles from a surface, with a detoning member, in an electrostatographic machine in contact with a cleaning member, comprising:

activating a sensing mechanism from the level of particles in the cleaning member prior to reaching an unacceptable emissions levels and cleaning failures resulting in servicing of the cleaning member;

stopping operation of the electrostatographic machine; and moving the detoning member and the cleaning member, relative to one another to enable removal of the particles from the cleaning member, the cleaning member being located between the detoning member and the surface.

17. A method as recited in claim 16, further comprising changing directions of motion, including a first direction and a second direction, of the cleaning member.

18. A method as recited in claim 17, wherein changing directions of motion comprises moving the cleaning member in the second direction of motion, opposite the first direction of motion, relative to the detoning roll.

19. A method as recited in claim 18, wherein changing directions of motion comprises moving the cleaning member in the second direction of motion, opposite the first direction of motion, relative to the surface.

20. A method as recited in claim 19, further comprising:

restarting operation of the electrostatographic machine; and changing the direction of motion of the cleaning member from the second direction of motion to the first direction of motion.

* * * * *